US007417199B2

(12) United States Patent
Nielsen

(10) Patent No.: US 7,417,199 B2
(45) Date of Patent: Aug. 26, 2008

(54) MULTIPLE SWITCH SELECTION DEVICE

(75) Inventor: Henning Nielsen, Struer (DK)

(73) Assignee: Bang & Olufsen A/S, Struer (DK)

( * ) Notice: Subject to any disclaimer, the term of this patent is extended or adjusted under 35 U.S.C. 154(b) by 0 days.

(21) Appl. No.: 10/580,104

(22) PCT Filed: Nov. 18, 2004

(86) PCT No.: PCT/DK2004/000797

§ 371 (c)(1),
(2), (4) Date: Nov. 30, 2006

(87) PCT Pub. No.: WO2005/050687

PCT Pub. Date: Jun. 2, 2005

(65) Prior Publication Data

US 2007/0137993 A1 Jun. 21, 2007

(30) Foreign Application Priority Data

Nov. 21, 2003 (EP) ..... 03026492

(51) Int. Cl.
*H01H 9/26* (2006.01)

(52) U.S. Cl. ..... 200/5 E; 200/5 A

(58) Field of Classification Search ..... 200/5 R, 200/5 A, 4, 18, 5 E, 6 A, 1 B, 5
See application file for complete search history.

(56) References Cited

U.S. PATENT DOCUMENTS

| | | | | |
|---|---|---|---|---|
| 3,679,846 | A * | 7/1972 | Dillon et al. | 200/6 A |
| 6,246,019 | B1 * | 6/2001 | Nakamura et al. | 200/6 A |
| 6,713,692 | B2 * | 3/2004 | Yamasaki | 200/6 A |
| 6,897,391 | B2 * | 5/2005 | Gavalda | 200/512 |
| 7,176,392 | B2 * | 2/2007 | Mimata et al. | 200/5 R |
| 2004/0226807 | A1 * | 11/2004 | Ashton | 200/5 R |
| 2006/0113170 | A1 * | 6/2006 | Rochon et al. | 200/5 R |

* cited by examiner

*Primary Examiner*—Michael A Friedhofer
*Assistant Examiner*—Lisa N Klaus
(74) *Attorney, Agent, or Firm*—James Creighton Wray; Clifford D. Hyra

(57) ABSTRACT

The present invention describes a multiple switch selection device where the movement of the first member may be very limited such that the overall construction height of the device may be very shallow, whereby the applications where such a multiple switch selection device can be built in, may be widened. Furthermore, it is also an object of the present invention to make the multiple switch selection device more versatile such that a wider range of input may be generated from one single device.

8 Claims, 2 Drawing Sheets

MULTIPLE SWITCH SELECTION DEVICE

This application claims the benefit of European Application No. 03026492.3 filed Nov. 21, 2003 and PCT/DK2004/000797 filed Nov. 18, 2004, which are hereby incorporated by reference in their entirety.

BACKGROUND OF THE INVENTION

The present invention relates to a multiple switch selection device.

These types of devices may advantageously be used in connection with for example telephones, remote controls or other appliances for, as an example, television sets, radios and the like. By manipulating a first member it is possible to select which switch should be activated, for example according to a menu on the television screen. In this manner it is possible to leaf through different selections and by appropriate selection procedures switch between the different menus. For example on a telephone, it might be desirable to select the telephone book first and thereafter select the entries listed under the letter "K" and after this finally select and call one entry listed under the entry "K". Correspondingly, for television sets these devices may be used in order to select the sound quality, the sound level, the colour tone etc. by leafing through different menus which will be presented on the screen.

The known types of devices function by rotating a first member in relation to a second member until the cursor, for example a colour bar on the television screen, has moved to the entry which is desirable to select. Thereafter, by depressing the entire first member, this depressing will be regarded as "enter" and the selected entry will be chosen. In order to achieve a determined selection, the first member has to be firmly depressed such that a firm switch action is achieved.

From U.S. Pat. No. 5,621,196 is a known construction which typically is found as tuning buttons on stereo systems. The document discloses two different constructions, where both constructions have the fact in common that the device is a different type of selection device within the meaning of the present invention in that it is not possible to turn the button endlessly in one or the other direction. Due to the configuration of stationary and moveable contact points respectively arranged on an insulating substrate connected to the housing of the device and on an elastic substrate mounted on the rotatable button, such that after the two parts have engaged and an input is registered, the elastic nature of the substrates will bias the button to return to its original position. Secondary input may be achieved by tilting and/or depressing the button, thereby activating resilient switch means which in response to the action will deform an thereby signal to the user by tactile response that an input has been activated.

Furthermore, due to the multidirectional character as well as the construction combining a housing in which housing a plurality of substrates and various contacts are arranged, as well as the possibility to tilt and depress the button, the overall construction height is rather high and bulky, and furthermore the button must project from the surface in order for a user to hold the button and perform the desired manipulation in order to activate the different switches. Also, the use of elastic materials (rubber) only provides a limited service life in that the rubber will deteriorate and eventually disintegrate.

In U.S. Pat. No. 5,939,684 another example of a prior art device is disclosed. This device comprises two rotatable buttons. On a PCB a jog and shuttle switch is mounted which is adapted to register the movement of the centrally arranged button. In order to isolate the movement of the centrally arranged button and the outer button arranged coaxially with the inner button, a PCB holder is provided, which holder serves to distribute pressure/input from the outer button to switches provided on the PCB. In operation the two buttons therefore by being rotatably and tiltably mounted, with aid from the PCB and the PCB holder elements, may direct input to/from the different switches mounted on the PCB and register input from the jog respectively shuttle switches arranged coaxially with the inner button. The outer button is furthermore limited in its ability to rotate and will be biased towards a "rest position". The centrally arranged button is connected to an adjustable resistor (potentiometer) whereby no endless rotational movement may be carried out, but only movement corresponding to an analogue input may be generated.

SUMMARY OF THE INVENTION

It is an object of the present invention to provide a multiple switch selection device where movement perpendicular to the general plane of the first member may be very limited such that the overall construction height of the device may be very shallow, whereby the applications where such a multiple switch selection device can be built-in, may be widened. Furthermore, it is also an object of the present invention to make the multiple switch selection device more versatile such that a wider range of input may be generated from one single device. It is a further object to simplify the construction of the prior art devices, and at the same time improve the usability and reliability of the device.

This is addressed by a multiple switch selection device according to the invention which is particular in that a first member is rotatably and tiltably arranged in relation to a second member, and that on said second member one or more switch devices are arranged within the periphery of said first member, such that by tilting said first member one or more switches on said second member may be activated.

By not having to depress the first member in relation to the second member, the overall construction height may be limited. The tilting action requires much less movement and thereby construction height in that the switches, especially if they are of the tactile micro switch dome type, require only a very limited depression in order to be activated. By arranging the first member in a tilting manner, the overall construction height may be very low and, at the same time, the movement corresponding to the depressing of the conventional devices, in this case the movement of the periphery of the first member, may, due to the tilting action, be as little as two tenth of a mm. Of particular interest are micro dome switches of the metal dome type. These switches are activated by relative movement of $^{2}/_{10}$-$^{3}/_{10}$ mm such that when a very shallow construction is desirable, it is possible to place the first and second members in very close relationship, thereby only allowing for very slight movement of the first member (input part). With this type of switches arranged in cooperation with the tilting first member, extremely shallow constructions may be designed. Other switches having longer movement necessary for activation may also be used. Of particular interest are switches having an activating movement of 1.3 to 3 mm, more preferred 0.2 to 1 mm, and most preferred 0.2 to 0.3 mm.

A switch selection device constructed as set out above, has a very shallow construction height, and the first member may be arranged flush with the outer surface of a device in which the multiple switch selection device is built-in.

In a further preferred embodiment, a reflective optical encoder is arranged in said second member, and that discrete reflective means are provided on the side of the first member facing the reflective optical encoder.

The reflective optical encoder in corporation with the discrete reflective means arranged on the underside of the first member, increases the possibility for creating more different inputs deriving from the device. The reflective optical encoder makes it possible to register how many reflective means pass the encoder, whereby the amount of rotation of the first member in relation to the second member may be registered. The reflective optical encoder is also able to detect the direction of rotation. Consequently, a composite input may be generated (direction of rotation, number of passes and activation of a switch). In this manner, in addition to registering the activation of one or more switch devices, it may also be possible to register the number of rotations or the angle of rotation of the first member as well as the direction of rotation in relation to the second member. This input may be treated, for example by an integrated circuit, such that both the angle which the first member travels trough and the actual contact which is activated, determines the input deriving from the device.

This implies that turning the first member for example 60° before activating a switch, will generate one type of input where turning the first member 420°, i.e. a full circle, before turning it the last 60° corresponding to the first example, will create a second type of input in that the reflective means registered by the reflective optical encoder will have registered that a higher number of reflective means have passed the encoder in relation to the first example. In this manner, it is possible to vary the input from the switch device to a great extent.

Corresponding advantages may be obtained by using other contactless registration of the rotation such as for example using so-called Hall magnetic sensors. The optical encoder is replaced by a Hall magnetic sensor. The sensor may be of the type commercially available from Sentron AG of Switzerland.

On the underside of the rotatable first member, the reflective means are replaced by discrete conductive means, for example strips of a termomagnetic film. As the first member is rotated, the Hall sensor will register the number of pulses generated by the passing conductive means, and in this manner it is possible to calculate or determine the input.

In a further advantageous embodiment of the invention the device is provided with one or more tactile switch devices which are evenly arranged along and inside the periphery of the first member on the second member, and that tilting the first member in a position superposing a switch generates a first signal, and tilting the first member in a position whereby two switches are activated generates a second signal, wherein the first signal depends on which of the one or more single switches is activated, and the second signal is independent of which switches are activated.

By further providing the possibility of registering not only the input deriving from activation of one particular switch, but also registering the input from two switches activated at the same time, it is in this way possible to differentiate the input and thereby further improve the versatility and use of the device according to the invention.

The integrated circuit may further by programmed such that the one, two or more tactile switch devices not only generate independent signals, but also the coincidental activation of two switches may generate a second type of signal, but also, depending on which two switches are activated at the same time, this coincidental determined activation may also be registered as a third type of signal.

In a further advantageous embodiment of the invention an intermediate load transferring and distributing member is arranged between the first member and the second member, where said intermediate member comprises a relatively stiff upper layer made from materials such as metals, plastics or similar materials and a lower resilient layer made from materials such as rubbers, plastics or similar materials, and that said intermediate member has an area at least such that it covers the switches arranged on the second member.

The intermediate member serves mainly two purposes: Firstly, it translates the input from the first member to the second member by means of a resilient member such that the switch devices are activated in the most appropriate way, namely by a resilient layer, for example made from rubber, whereby the wear and tear on the tactile switch device is minimised. And secondly, by providing an upper layer which is relatively stiffer than the lower layer of the intermediate member, the transferal of force from the first member through the two layers of the intermediate member to the switch device is assured even with a very small movement of the first member.

In a still further advantageous embodiment of the invention the first member is a disc, which disc is connected to the second member by means of a bearing, such that an axle provided centrally in the disc and perpendicular to the plane of the disc is held with play in an aperture provided in the intermediate member and the second member or alternatively that either the axle or the inside wall of the aperture is conically shaped, such that the axle may tilt in relation to the plane of the second member, whereby the tilting action of the first member is facilitated.

In order to provide the tilting action, two alternative embodiments of the bearing between the first member and the second member is contemplated. In the first embodiment, the outer diameter of the centrally arranged axle in the first member is smaller than the inner diameter in the aperture constituting the second part of the bearing provided in the second member. By having this play arriving from the differences in diameter, it is possible, by appropriate dimensioning of the differences in diameter, to provide the necessary free play between the two members such that both a firm rotation action may be provided and, at the same time, the tilting in the free play space between the two parts of the bearing provides sufficient movement along the periphery of the first member (disc) such that both smooth movement when rotating the member, but also a firm and easy depression of the first member in order to activate a switch device can be provided.

In a second embodiment of the bearing, either the aperture provided in the second member or the shape of the axle provided in the first member may be conical, such that the tilting action is provided by one member being cylindrical and the other member being conical such that the play deriving from such a configuration provides for the tilting action. As the tilting action of the first member in relation to the second member and thereby the switch devices is very limited, i.e. approximately two millimeters, the necessary free play in the bearing is very limited.

In a further advantageous embodiment of the invention a dome foil is provided where said foil covers the upper surface of the second member and the upper surfaces of the switch devices, and that in the aperture constituting the bearing wall in the aperture, two rings comprising flanges are provided, where said rings may be pressed together in interlocking relationship such that the second member and the intermediate member are held by the flanges of the two rings.

Typically, the second member will be a printed circuit board on which the components necessary for providing the circuitry for carrying out the data processing from the input device as well as other circuitry for carrying out the object of the PCB, for example when installed in a cell phone or a remote control, are mounted. In order to protect the PCB from the ingress of moisture, grease and other substances which may be detrimental both to the proper functioning of the selection device, but also for the proper functioning of the PCB, the dome foil is provided as a protective layer, which may cover the entire PCB and be fastened between the intermediate member and the second member such that a moisture-tight seal is also provided here.

Especially in applications such as cell phones, navigational equipment and other types of equipment which may be exposed to moisture, dirt or the like, the provision of the inventive device in addition to the provision of a very shallow construction height whereby the overall dimensions of the device may be minimised, the provision of a substantially fluid-tight construction in combination with a user-friendly and reliable switch device, gives such devices added advantages in comparison to prior art devices.

The very shallow construction height of the multiple switch device according to the present invention is also provided due to the assembly of the bearing by squeezing two rings together such that one will press-fit inside or outside the other one, such that flanges provided on the two rings in such a manner that by pressing the two rings together, the distance between the flanges provided on each ring will be such that they will mildly squeeze and thereby firmly hold the second member and the intermediate member and optionally including the protective foil. In addition to providing a very shallow construction height a relatively simple, but reliable, bearing construction, it also provides for a cheap overall device construction.

In the embodiments where a reflective optical encoder is provided in the device, the reflective optical encoder is mounted on the PCB and a corresponding aperture is provided in the intermediate member such that the optical encoder may read from the discreet reflective means arranged on the underside of the first member.

The reflective means may be printed on the underside of the first member, either by printing with a reflective material in cases where the first member is made from a non-reflective material or non-reflective print in cases where the ability of the material from which the first member is made to reflect the light beam from the optical encoder is sufficient in order to receive a reliable signal. Alternatively, paper, aluminium foil or the like may be adhered to the underside in order to create a pattern of reflective and non-reflective areas evenly distributed along the underside of the first member in order for the reflective optical encoder to register movement/rotation of the first member.

In a still further advantageous embodiment of the invention, the first member may be provided with a torus on the side facing the second member, and that on the intermediate member facing the second member protrusions superposed the switches arranged on the second member are provided, and optionally between the protrusions and the bearing a number of secondary protrusions may be provided.

The torus serves to limit the distance which the first member needs to tilt in order to create sufficient depression in the switch in order to register the input deriving from the tilting action, but also to define exactly where the depression force is transmitted to the underlying construction. On the first member, the torus is provided substantially continuous at a predetermined distance from the edge of the first member, substantially completely around the first member. On the intermediate member acing the second member, the protrusions are only provided superposed and overlaying the switches provided on the second member. In this manner, when the first member is tilted, only a limited tilt is necessary in order for the torus to transfer the action to the protrusion and thereby onto the switch in order to register the input. A secondary effect achieved by this arrangement is the fact that dirt, such as sand, grease or the like, only to a very limited extent will gain access to the bearing construction as the torus is substantially in close contact with the upper layer of the intermediate member.

The secondary protrusions provided on the intermediate member serve as an overload stop such that if the first member should be exposed to a very high force/depression, the switch member will not be damaged, but the force will be absorbed by the secondary protrusion, which will come into contact with the second member.

The first member may be formed from any suitable material such as metals, for example stainless steel.

Although the device as such has been explained above, in a further advantageous embodiment of the invention an electronic hand-held device such as a mobile phone, hand held computer, navigation device or other appliances such as for example radios, televisions, telephones or any other appliance where it is desirable to allow a user to enter input, comprising such a device as described above, falls within the scope of the invention. Due to the qualities of the device as explained above with respect to the very shallow construction height, the very versatile usability, the possibility of utilising and combining different sets of input as input to an integrated circuit and thereby, by appropriate data treatment means, converting the input to a wide variety of commands, this type of device is especially suitable for being built into small electronic equipment. The invention is as such suitable with any type of appliances where it is desirable to allow a user to enter input.

The invention will now be explained with reference to the accompanying drawing, wherein

DETAILED DESCRIPTION OF THE PREFERRED EMBODIMENTS

Figure 1:
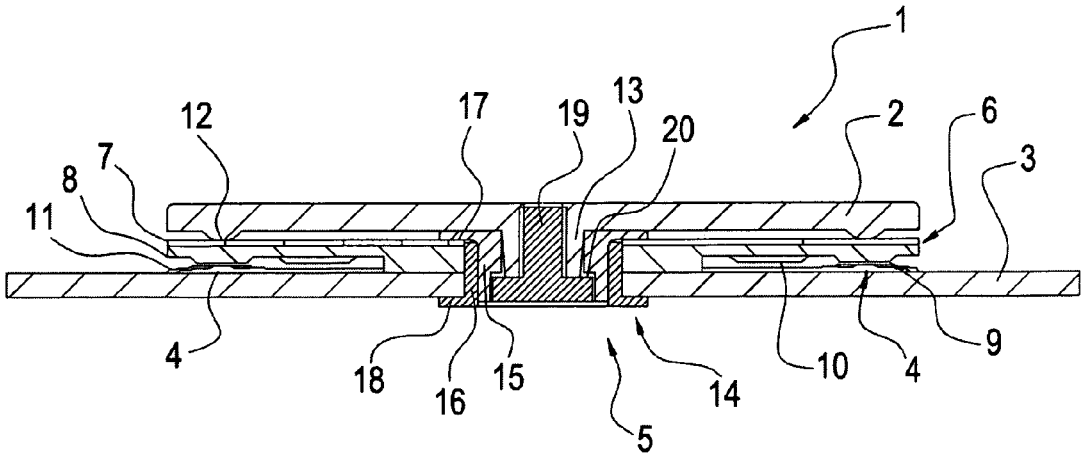
FIG. 1 is a cross-section through an embodiment of the invention.

In FIG. 1 a cross-section through a device 1 according to the invention is illustrated. A first member 2 is rotatably and tiltingly arranged in relation to a second member 3. The second member 3 is typically a printed circuit board (PCB) onto which PCB a number of switch devices 4 are provided. The first member 2 is a disc which can rotate and tilt due to the construction of the bearing 5.

In order to transfer the input when the disc 2 is tilted, an intermediate member 6 is arranged between the disc 2 and the PCB 3. The intermediate member is a layered construction where the upper layer 7 is made from a relatively stiff material such as for example a metal or a plastic disc made from e.g. Teflon® or Delarin®. The lower layer 8 is made from a relatively softer material such as for example rubber or any other resilient material. The purpose of the intermediate member 6 is to transfer the load created by a user when the disc 2 is tilted. The load is transferred through the intermediate member 6 onto the switch member 4. In order to further limit the amount or travel needed for the edge of the disc 2 and in order to assure a determined activation of the switch 4, the intermediate member 6 may be provided with protrusions 9, which protrusions 9 are superposed the switches 4.

In order to protect the switch devices 4, secondary protrusions 10 may be provided inside the first protrusions 9 on the lower layer of the intermediate member 6.

Furthermore, a foil 11 is provided, which foil 11 at least covers the switch devices 4, but may extend across the entire top surface of the PCB 3. On the PCB other input devices may be arranged, such as regular tactile push buttons, which buttons may also be covered by the foil 11. By arranging the foil covering the switch devices 4 on top of the PCB 3 is achieved that foreign matter such as moisture, grease, dirt and other sub-stances which may be detrimental to the proper functioning of the device, do not gain access to the PCB and the often fragile electronic circuitry arranged on the PCB.

Returning to the disc, the disc is provided with a torus 12, which is superposed the protrusions 9 arranged in the intermediate member 6, such that only very limited movement of the disc 2 is necessary in order to activate the switch device 4. Furthermore, the torus 12, which in this example is circular, extends substantially around the underside of the disc 2, hinders foreign matters in entering the space between the disc member 2 and the intermediate member 6.

Turning to the construction of the bearing 5, the disc 2 is provided with a centrally arranged axle 13. In this example, the axle is slightly conical, such that the diameter of the axle is larger closer to the disc than further away from the disc. In order to radially support the axle 13, a bearing 14 is provided, which bearing 14 is attached to the PCB and intermediate member. In this example, the bearing 14 is constructed by press-fitting two rings 15, 16, which rings each comprise a flange 17, 18 such that as the rings 15, 16 are press-fitted together, the flanges 17, 18 will squeeze the intermediate member 6 and the PCB 3 together, whereby a firm fitting of the bearing 14 is achieved and at the same time the intermediate member 6 is fixated in relation to the PCB 3. In order to further fasten the disc 2 rotatable to the construction, a pin 19 is provided centrally in the axle 13, such that the disc member 2 may rotate in the bearing, but is held by the pin member 19 due to the wide T-sections of the pin member 19 engaging shoulders 20 provided on ring 15.

As an alternative to the construction comprising pin 19, the axle 13 may extend to the underside of the bearing 14 and in place of the T-section of the pin member 19 a disc or other locking pin member may be provided on a distal end of the axle 13 for engagement against the shoulders 20, such that the disc cannot be accidentally moved from the bearing 14.

Figure 2:
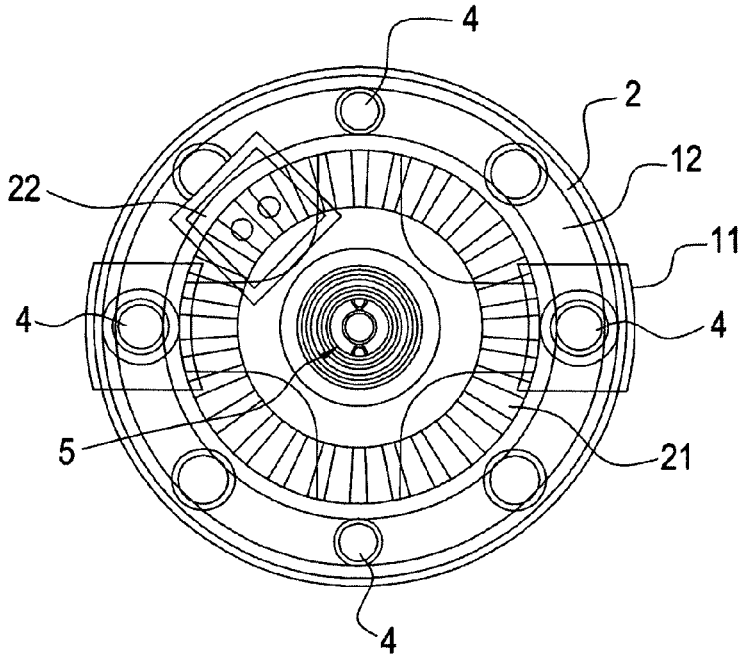
FIG. 2 is a plane "transparent" view of a device.

Turning to FIG. 2, a plain view of the device is illustrated. In order to be able to see the different features of the device, the illustration is illustrated in a "transparent" view.

A number of switches 4 are arranged around the periphery of the device. Additionally, discrete reflective means are provided on the underside of the disc member 2 such that as the disc is rotated, the reflective means 21 will travel across the reflective optical encoder 22 such that a signal will be generated by the reflective optical encoder corresponding to the rotational movement of the disc 2. On the disc, as illustrated in FIG. 1, the torus 12 is arranged such that it will superpose the switches 4. Furthermore, the foil 11 is in this embodiment, illustrated as only covering the area around the switch 4, but may as explained above, cover the entire surface of the PCB including the switch devices 4. The centrally arranged bearing assembly 5 is illustrated with respect to FIG. 1 above.

Figure 3:
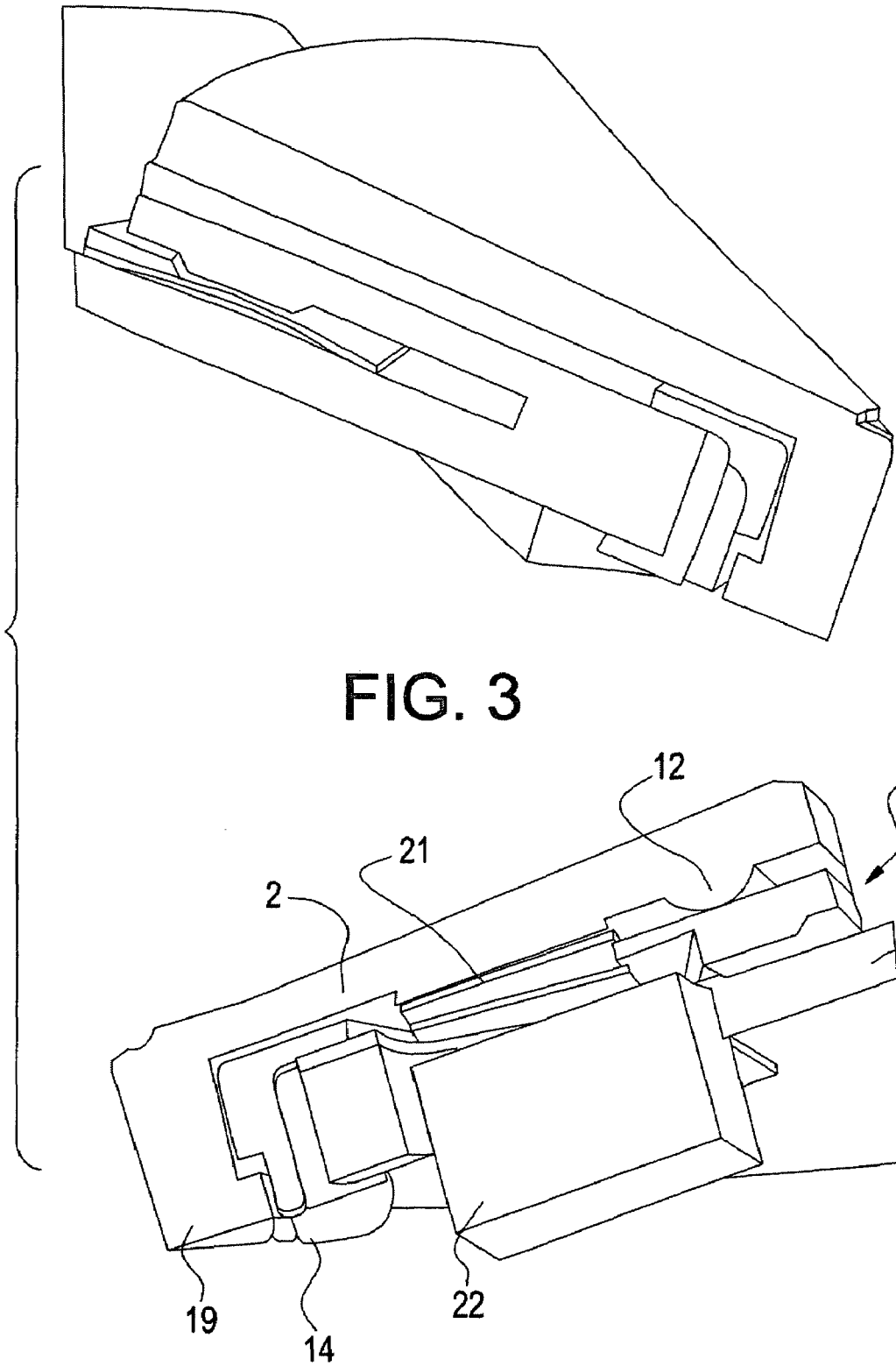
FIG. 3 is an isometric view of the device.

In FIG. 3, an isometric view of the device according to the invention is illustrated, where like features are denoted by the same reference numbers as above. As can be clearly seen, the reflective optical encoder 22 is arranged in a aperture in the PCB 3. The intermediate member 6 is provided with a corresponding aperture such that the reflective optical encoder may be able to read the discrete reflective means 21 arranged on the underside of the disc 2. As the disc 2 is rotated in relation to the reflective optical encoder 22, the discrete reflective means 21 will pass and alternately reflect and not reflect the light beam emitted from the reflective optical encoder, whereby a signal may be generated such that the angle of rotation or number of complete rotations of the disc in relation to the reflective optical encoder 22 may be deduced. In this way it becomes possible to select data from a long list of possibilities simply by rotating the disc the appropriate number of evolutions, i.e. corresponding to the passage of an appropriate number of reflective means 21 in relation to the optical encoder 22.

What is also clear from the illustration in FIG. 3 is the very shallow construction height of the entire device, whereby the device is suitable for being used in hand-held electronic equipment such as cell phones, navigational equipment, hand-held computers and other like devices. Due to the construction of the device such that the reflective optical encoder simply counts the number of pulses generated by the discrete reflective means 21, which are passed in front of the beam emitted by the reflective optical encoder 22 a very versatile device is provided. By using the tilting action of the disc 2 as an "enter" command, regardless of the position of the pressure, i.e. between two discrete switches 4, a simple and user-friendly input device is created. By further allotting different and well-specified commands to the switches arranged around the periphery of the disc, for example by indicating on the adjacent surface the specific functioning of that switch device, the multiple switch selection device according to the invention, in addition to being able to leaf through endless menus and select commands from a menu line, may also be used for direct input, namely by activating one pre-specified switch device.

Although the invention has been explained with reference to a specific embodiment as detailed above, it will be evident for the skilled person that a device comprising the features and advantages as set out above, especially in view of its very shallow construction, will be applicable for a number of applications. Although a few applications have been mentioned within the description, the invention as such is not limited, neither to the detailed description of a detailed embodiment as explained above with reference to the drawing, nor with reference to the mentioned applications, but may solely be limited by the scope of the claims as set out below.

The invention claimed is:

1. Multiple switch selection device, wherein a first member 2 is rotatable and tiltably arranged in relation to a second member 3, and that on said second member 3 one or more switch devices 4 are arranged within the periphery of said first member 2, such that by tilting said first member 2 one or more switches 4 on said second member 3 are activated, characterized in that the switches 4 are of the tactile micro switch dome type, whereby a very low overall construction height is achieved, and that activation of a switch 4 occurs only by tilting the first member 2 as little as $2/10$ mm at the periphery of the first member 2, wherein the first member is a disc, which disc is connected to the second member by means of a bearing, such that an axle provided centrally in the disc and perpendicular to the plane of the disc is held with play in an aperture provided in the intermediate member and the second member or alternatively that either the axle or the inside wall of the aperture is conically shaped, such that the axle may tilt in relation to the plane of the second member, whereby the tilting action of the first member is facilitated.

2. Device according to claim 1, wherein a reflective optical encoder is arranged in said second member, and that discrete reflective means are provided on the side of the first member facing the reflective optical encoder.

3. Device according to claim 1, wherein one or more tactile switch devices are evenly arranged along and inside the periphery of the first member on the second member, and that tilting the first member in a position superposing a switch generates a first signal, and tilting the first member in a position whereby two switches are activated generates a second signal, wherein the first signal depends on which of the one or more single switches is activated, and the second signal is independent of which switches are activated.

4. Device according to claim 1, wherein an intermediate load transferring aid distributing member is arranged between the first member and the second member, where said intermediate member comprises a relatively stiff upper layer made from materials such as metals, plastics or similar materials and a lower resilient layer made from materials such as rubbers, plastics or similar materials, and that said intermediate member has an area at least such that it covers the switches arranged on the second member.

5. Device according to claim 1, wherein a dome foil is provided where said foil covers the upper surface of the second member and the upper surfaces of the switch devices, and that in the aperture constituting the bearing wall in the aperture, two rings comprising flanges are provided, where said rings are pressed together in interlocking relationship such that the second member and the intermediate member are held by the flanges of the two rings.

6. Device according to claim 1, wherein the first member is provided with a torus on the side facing the second member, and that on the intermediate member facing the second member protrusions superposed the switches arranged on the second member are provided.

7. Electronic device or other appliance where it is desirable to allow a user to enter input, comprising a device according to claim 1.

8. Device according to claim 6, wherein between the protrusions and the bearing a number of secondary protrusions are provided.

* * * * *